United States Patent [19]

Hilal

[11] 4,224,938

[45] Sep. 30, 1980

[54] BALANCED SECOND STAGE FOR A TWO STAGE DEMAND REGULATOR

[75] Inventor: Said S. Hilal, Long Beach, Calif.

[73] Assignee: American Underwater Products, San Leandro, Calif.

[21] Appl. No.: 7,567

[22] Filed: Jan. 29, 1979

[51] Int. Cl.[3] ..... B63C 11/16

[52] U.S. Cl. ..... 128/204.26; 137/494; 137/DIG. 9; 137/505.46; 137/505.47; 137/508

[58] Field of Search ..... 128/142.2, 142 R, 147, 128/204.26; 137/494, 102, DIG. 9, 505.46, 505.47, 508; 251/353, 335 A, 58

[56] References Cited

U.S. PATENT DOCUMENTS

| | | | |
|---|---|---|---|
| 2,523,036 | 9/1950 | Maitland et al. | 137/494 |
| 2,654,561 | 10/1953 | Trefil | 251/335 A |
| 2,695,609 | 11/1954 | Nourse et al. | 137/494 X |
| 2,750,957 | 6/1956 | Tavola | 251/335 A X |
| 3,250,292 | 5/1966 | Mollick | 137/505.41 X |
| 3,362,429 | 1/1968 | Volsk | 137/494 |
| 3,938,511 | 2/1976 | Roberts | 128/142.2 |

FOREIGN PATENT DOCUMENTS

| | | | |
|---|---|---|---|
| 661702 | 4/1963 | Canada | 128/142.2 |

*Primary Examiner*—Henry J. Recla

[57] ABSTRACT

An air valve for the demand or second stage of a scuba regulator disposed between the intermediate pressure region and the low or breathing pressure region which includes, a stationary valve seat and a tubular, movable valve element whose sealing edge is sealingly biased against the valve seat. The interior of the tubular element is in communication with the low pressure chamber and the forward portion of the exterior of the tubular element is in communication with the intermediate pressure chamber. And a flexible sealing means forming a wall between the low and the intermediate pressure regions and supporting the valve element for limited movement between a closed and an open position.

18 Claims, 4 Drawing Figures

BALANCED SECOND STAGE FOR A TWO STAGE DEMAND REGULATOR

This invention relates to pressure regulators for divers, also known as scuba regulators, and more particularly to an improved second stage for such a pressure regulator, also known as the demand stage.

There are a number of pressure regulators for sports divers known in the prior art which typically have two stages. The first stage reduces the pressure from a tank or cylinder in which the compressed air is stored at a high pressure, somewhere between 2,000 and 4,000 pounds per square inch, to an intermediate pressure which is typically 129 pounds per square inch above ambient pressure. The second or demand stage reduces the pressure from the intermediate pressure of 125 pounds per square inch above ambient to demand pressure which is usually close to the ambient pressure to which the diver is exposed. This ambient pressure is substantially equal to 0 pounds per square inch at sea level (all pressures measured with respect to sea level) and to 43.4 pounds per square inch at a water depth of 100 feet.

Generally, the second or demand stage of a scuba regulator includes a low pressure chamber with a flexible diaphram across a chamber opening which is exposed to the ambient pressure, an intermediate pressure chamber (or air supply), and an air valve separating the chamber. As the diver breathes and demands air, the diaphragm actuates a control level connected to the valve element in the air valve and to open the valve to the intermediate pressure chamber, maintained at 125 pounds per square inch above ambient, to supply air to the low pressure chamber for breathing by the diver.

Since actuation of the second stage of the regulator is accomplished by the diver sucking air into his lungs, this being the demand pressure, it will be appreciated that the suction which the diver has to exert on the diaphragm should be as small and as constant as possible. In fact, it is desirable to limit the effort of the diver to open the second stage to a force of about one inch of water, which is equal to approximately 0.034 pounds.

Many of the prior art pressure regulators have second stages which are unbalanced which, in the context of this application, means that as the valve element is moved from the closed to the open position, the forces acting on the valve element change materially. More particularly, when the end sealing valve seat is in the movable valve element as is common, the forces urging the valve element to remain in the open position decrease, thereby requiring a greater effort by the diver to maintain the valve in the open position and preventing the valve from closing before he has been supplied with the desired quantity of air. This is because the high pressure acting on the valve element is unable to continue exerting the force on the valve element, and the valve element has a tendency of returning immediately to the closed position unless maintained in the open position by extra effort of the diver. Such a system is illustrated in U.S. Pat. No. 4,002,166.

Two other approaches have been proposed to overcome the imbalance of the demand stage of the regulator. One is illustrated in U.S. Pat. No. 4,076,041 which discloses a pilot valve where air pressure is controlled through a very small orifice, and by controlling the orifice, the regulator may be activated or shut off. The other approach is a tilt valve which, instead of pulling the valve element linearly from the closed to the open position, tilts the valve at an angle to the orifice so that the valve seat itself accepts part of the load. Both of these approaches, and combinations of the two approaches, are limiting in a number of ways and do not provide what is considered a balanced valve. In addition, the complexity of such valves increases considerably contributing to the cost of manufacture and requiring considerable maintenance.

SUMMARY OF THE PRESENT INVENTION

It is therefore a primary object of the present invention to provide a second stage for a demand regulator in which the valve is balanced, i.e., the forces due to air pressure acting on the movable valve element remain substantially constant as the valve is opened.

It is a further object of the present invention to provide a regulator which has a second stage which requires a relatively small force to open the air valve and which small force remains constant over a wide range of demands.

It is still a further object of the present invention to provide a regulator having a balanced demand stage which requires only a constant force of a magnitude substantially equal to the normal scaling force of the valve.

In accordance with the present invention, there is provided a tubular valve element which is movably supported by a flexible sealing means such as a membrane or a bellows, which not only functions as a frictionless, or at least low stiffness support, but also as a sealing partition between the intermediate and low pressure regions. The movable valve element includes an end sealing edge which cooperates with a stationary soft valve seat, and the valve element is biased in the sealed position by a spring which exerts a sealing force.

DETAILED DESCRIPTION OF THE PREFERRED EMBODIMENT

Figure 1:
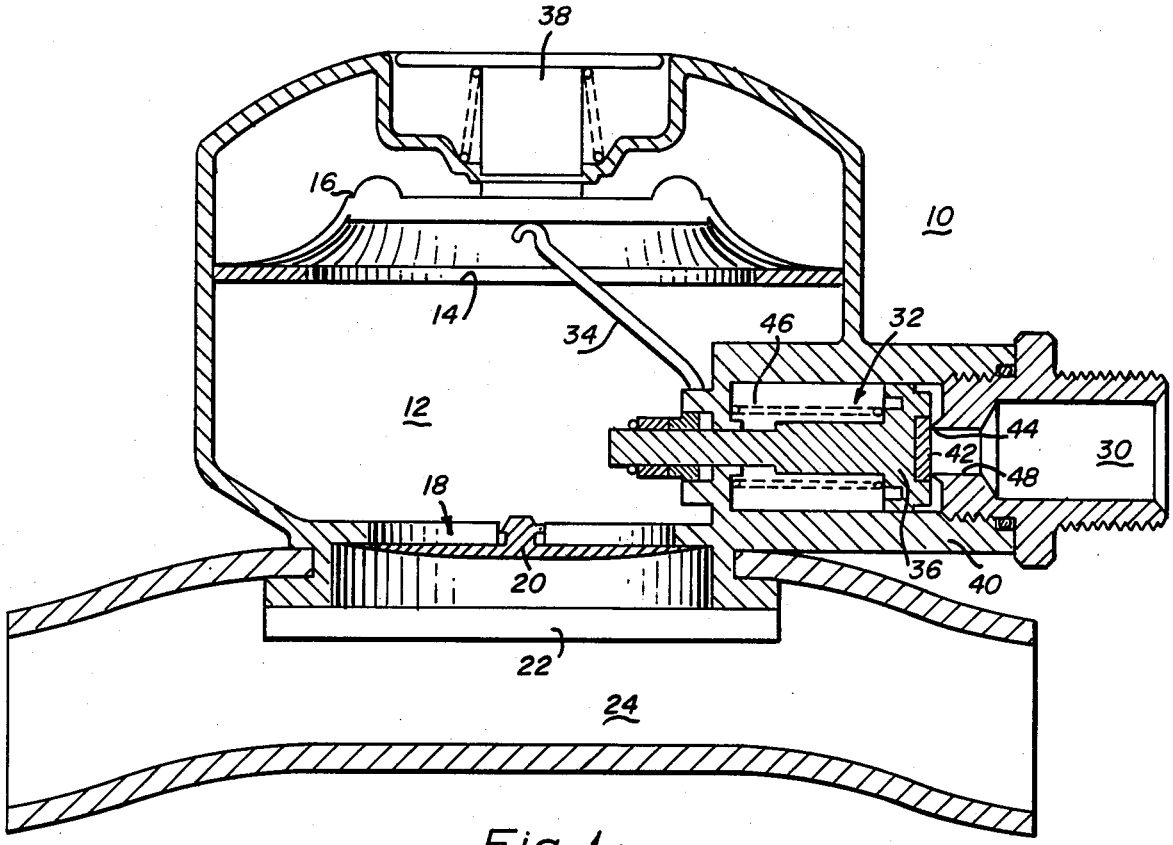
Fig 1 (PRIOR ART)
FIG. 1 is a cross-sectional view of the demand stage of a prior art pressure regulator illustrating an unbalanced air valve.

Referring now to FIG. 1 of the drawings, there is shown a "prior art" demand stage of a pressure regulator, generally designated as 10, comprising a low pressure chamber or region 12 having an opening 14 covered by a flexible diaphragm 16 and an opening 18 covered by an exhaust valve 20. Exhaust valve 20 is generally connected to an exhaust tee 24. There is also provided an intermediate pressure chamber or region 30 which is connected to an air storage cylinder, generally filled to 2000 to 4000 pounds per square inch, not shown, through a first regulative stage, likewise not shown, which reduces the air from high cylinder pressure to intermediate pressure which is typically 120 pounds per square inch above ambient pressure. Disposed between intermediate pressure chamber 30, which in actuality may be the hose from the output port of the first stage of the regulator, and low pressure chamber 12 is a valve 32, also referred to as an air valve.

Conventionally, air valve 32 is actuated to pass air from the air supply or intermediate pressure chamber 30 to low pressure chamber 12 by a demand lever 34 which operatively interconnects diaphragm 16 with a movable valve element 36. Air valve 32 also includes a housing 40 which has a movable valve element 36 carrying a resilient or soft valve seat 42 for cooperation with stationary sealing ring 44. Valve seat 42 is biased against sealing ring 44 by compression spring 46 and lever 34 is connected to move valve element 36 from the closed position, in which it is shown, to the open position. When valve element 36 is moved into the open position, air from intermediate pressure chamber 30 enters low pressure chamber 12 for inhalation by the diver. Upon the completion of the inhalation cycle, the higher pressure acts outwardly upon diaphragm 16 and spring 46 and pushes the valve element to once more close the valve.

In operation, when the diver takes a breath through mouthpiece tube 22, the pressure in low pressure chamber 12 is lowered and causes diaphragm 16 to move downwardly and actuate lever 34 to move valve element 36 to the open position allowing air from intermediate pressure chamber 30 to rush into low pressure chamber 12 until the pressure returns to ambient pressure. As the diver exhales, valve 20 opens and the exhaled air is expelled through exhaust tee 24. There is also provided a conventional purge button 38 which is normally depressed by the diver manually to cause the flushing out of low pressure chamber 12 and expell any water from mouthpiece tube 22 and exhaust tee 24.

For a full understanding of the problem encountered with the demand stage illustrated in FIG. 1, it will be helpful to make some calculations. Assume the size of the main orifice 48 of valve 32 to be 0.250 inches in diameter and an intermediate pressure of 125 psi above ambient. Further, assume that the sealing pressure that must be exerted on soft valve seat 42 to provide an airtight seal with edge 44 is 200 psi and that the area of the sealing ring 44 is 0.0032 square inches. The above dimension and pressures, which will be equally applicable to the description of the operation of FIGS. 2, 3 and 4, are typical and have been selected for the purpose of making a comparison.

Using the assumed dimensions and pressures, the force acting on movable valve element 36, defined as $F_1$, is the intermediate air pressure times the area of the orifice which is 6.14 pounds. The sealing force, defines as $F_2$, is equal to the area of the seating ring times the required pressure to seal which is 0.64 pounds. Accordingly, the force that spring 46 must exert upon valve element 36, defined as $F_3$, is the sum of $F_1$ plus $F_2$ which is 6.78 pounds. When the diver starts to inhale, the only force he has to exert on valve element 36 is $F_2$ or 0.64 pounds. However, as soon as valve element 36 moves into the open position, it no longer is subject to $F_1$ which is replaced by a dynamic force due to the mass of air hitting the seat at a certain velocity. This dynamic force, defined as $F_d$, is considerably smaller than $F_1$ and does not normally exceed 1.5 to 2.0 pounds. If the diver is exerting an effort $F_e$ and if upon that action of effort the diaphragm and the lever provide an opening force of $F_3$, the forces to retain the valve in the open position become $F_3=F_2+(F_1-F_d)$ and as explained above $(F_1-F_d)$ is in the neighborhood of 4 lbs. In other words, the diver has to exert a considerably greater effort than $F_2$ to retain the valve in the open position, and assuming $F_d$ to be equal to two pounds, the effort the diver has to maintain is 4.14 pounds.

Summarizing, for the valve illustrated in FIG. 1, the diver only has to exert a force $F_2$ of 0.64 pounds on the valve element to open the same because he is assisted by the force $F_1$ provided by the intermediate pressure, but as soon as the valve is open, the assist force $F_1$ drops, and a force of 4.14 pounds must be provided to breathe. This effect is true of all unbalanced valves and is not desirable.

Figure 2:
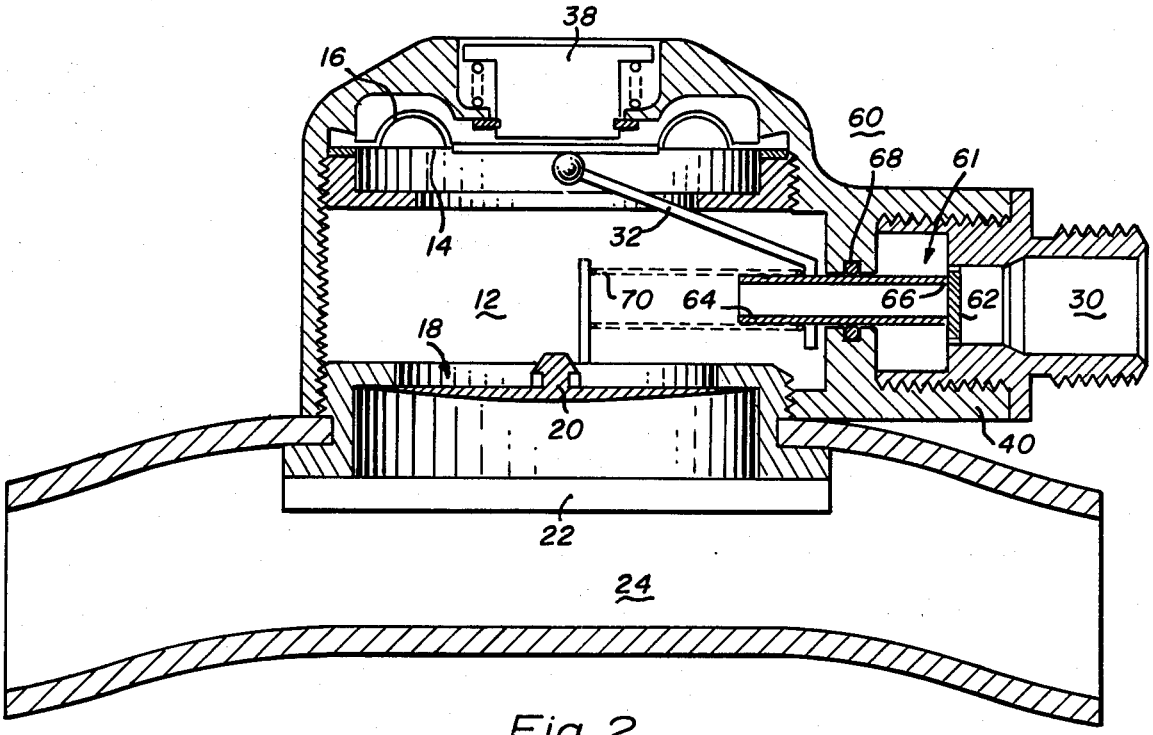
FIG. 2 is a cross-sectional view of the demand stage of a pressure regulator illustrating a balanced valve in accordance with the present invention.
Figure 3:
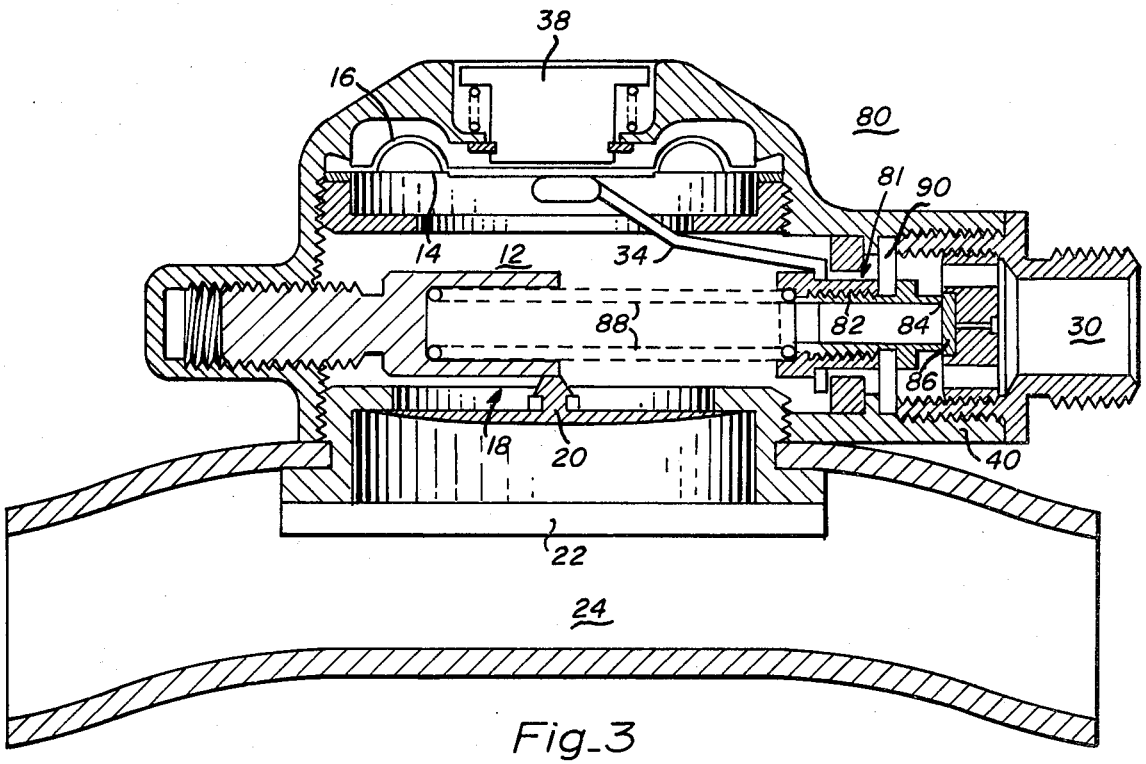
FIG. 3 is a cross-sectional view through the demand stage of a breathing regulator illustrating a preferred embodiment of the balanced valve of the present invention.
Figure 4:
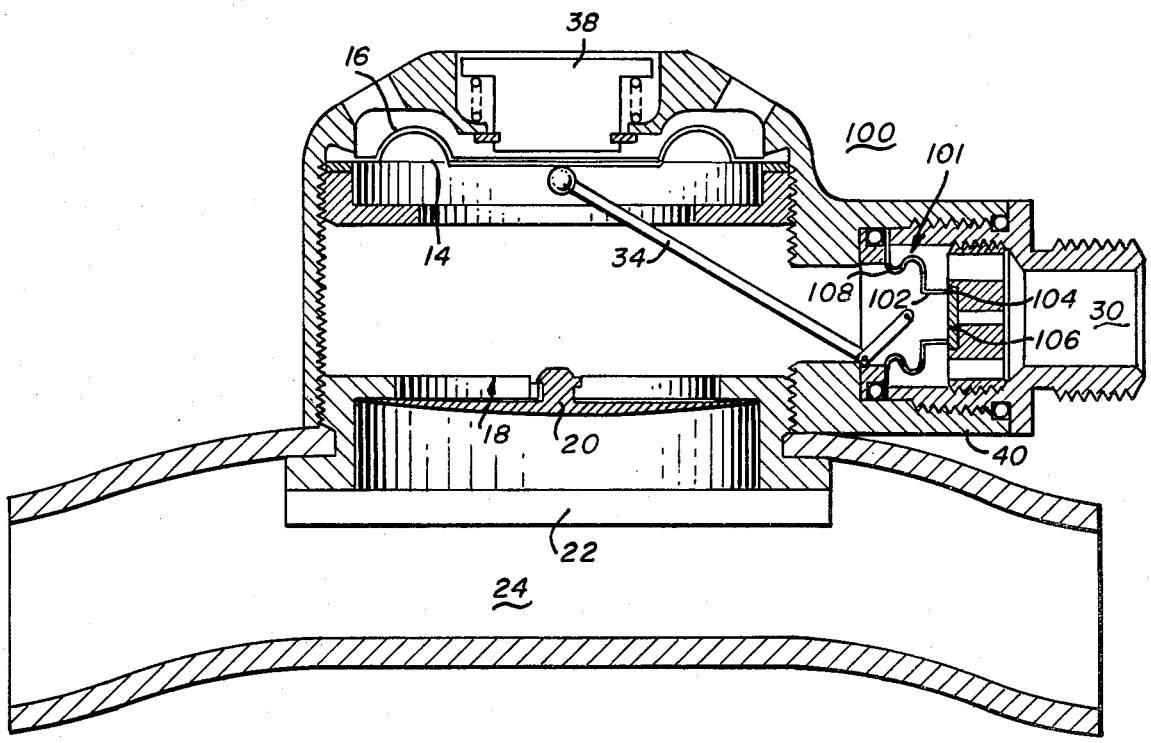
FIG. 4 is a cross-sectional view through the demand stage of a pressure regulator illustrating another embodiment of the balanced valve of the present invention.

In the description of FIGS. 2, 3, and 4, like parts to those of FIG. 1 have been designated with like reference characters. Referring now to FIG. 2, there is shown the demand stage 60 of a scuba regulator constructed in accordance with the present invention. Demand stage 60 has an air valve 61 including a stationary soft valve seat 62 and a movable valve element 64 which is of tubular construction and which has a sealing edge 66 which is urged into sealing contact with soft seat 62. Movable valve element 64 is disposed between intermediate pressure chamber 30 and low pressure chamber 12 and O-ring 68 provides a seal partition between these two chambers while allowing valve element 64 to move from a closed to an open position when actuated by demand lever 32. There is also provided a spring 70 which provides the sealing force $F_2$. In the open position of valve 32, air from the intermediate pressure chamber enters low pressure chamber 12 through the internal bore of movable valve element 66.

Assume the external diameter of tubular valve element 64 to be equal to 0.258 inches and the internal diameter to be equal to 0.250 inches, the latter figure being selected to be the same size as main orifice 48 of FIG. 1 to allow for a comparison. Accordingly, the force $F_2$ acting on the valve element is equal to the intermediate pressure times the area of the sealing edge which is 0.40 pounds. The sealing force, namely $F_2$, is the same as before, namely 0.64 pounds. Therefore, the force of the spring to retain valve element 64 in the closed position is equal to $F_1$ plus $F_2$ which is equal to 1.04 pounds.

Valve element 64 and therefore air valve 61 is balanced because, as the valve moves from the closed to the open position, the forces due to air pressure on the valve element do not materially change, $F_1$ remaining substantially constant. The only problem encountered with this kind of a demand regulator is the friction between O-ring 68 and the external surface of valve element 64. Because it is impossible to get a frictionless connection between the O-ring and the movable valve element, the spring will have to exert a force that is large enough to counteract the worst possible frictional condition, or the regulator may remain in the open position. Friction therefore acts to oppose both the opening and the closing efforts and, though it may not always be extensive, it will still have to be taken into account by requiring a closing spring which always exerts a force large enough to ensure closing. This requires the diver to exert a rather large force when demanding air.

Even with Teflon coated O-rings and other improvements, the friction may be sizable. Assuming that friction could reach a maximum of three pounds, and assuming this to be the worst condition, it will be necessary to have an added three pounds to the breathing effort which means the diver has to exert a force large enough to provide a force of 4.04 pounds. In this particular case, the force is constant, i.e., does not change when the valve is moved to the open position, but the amount of the force is considerable. If the frictional force could be reduced, the embodiment of FIG. 2 would be most satisfactory because it requires a constant force which may be considerably less than the keep open force of the prior art valve of FIG. 1.

Referring now to the demand stage 80 shown in FIG. 3, in which like reference characters designate like parts, there is provided an air valve 81 to separate the low pressure chamber 12 and the intermediate pressure chamber 30. Valve 81 comprises a tubular movable valve element 82 which has a seal rim 84 at its end which cooperates with a stationary soft valve seat 86. Movable valve element 82 is urged into sealing contact with valve seat 86 by means of a compression spring 88. Valve element 82 is supported for limited movement by flexible sealing means 90 which is a membrane-like wall which provides an air tight partition between chambers 30 and 12 and also a support for movable valve element 82.

In practice, flexible membrane 90 facilitates a balanced valve design and eliminates the frictional forces, such as the ones described in connection with FIG. 2. The only forces that may oppose limited movement of the valve element 82 are the stiffness of sealing means 90. The stiffness can be decreased by decreasing the thickness of the membrane and also by increasing the active radial width of the membrane. However, the greater the radial width of the membrane, the greater the forces and therefore the thicker the membrane must be made. It has been found that a radial width 0.060 inches with an outside diameter of 0.400 inches and a thickness of 0.098 inches is a good compromise providing almost negligible forces due to stiffness.

Assuming the outer exposed diameter of membrane 90 to be 0.400 inches and the internal diameter of the valve element to be, as before, 0.250 inches, then $F_1$ will be equal to 9.57 pounds. $F_2$ remains the same 0.64 pounds so that the force of the spring to retain the tubular valve element 82 in a closed position, namely $F_3$, must be equal to 10.21 pounds. Because air pressure remains acting on the same area, $F_1$ remains substantially the same when the valve is moved into the open position, the valve is balanced and the effort to be exerted by the diver is equal to $F_3$ minus $F_1$ which is 0.64 pounds. This, of course, is equal to the sealing force and this is constant. Accordingly, in the configuration shown in FIG. 3, the demand stage can be opened and maintained open with a constant low force, namely 0.64 pounds, if the minor amount of stiffness or stretch of membrane 90 is ignored.

Referring now to FIG. 4 of the drawing, there is shown a demand stage 100 with an air valve 101 constructed in accordance with the present invention in which like reference characters again designate like parts. Regulator valve 101 comprises a tubular valve element 102 which has a sealing rim 104 which cooperates with a soft valve seat 106. Between movable valve element 102 and supporting the same is a bellows 108 which has three functions. It provides a substantially frictionless support for movable valve element 102, it sealingly partitions chamber 12 from chamber 30, and it provides the sealing force, through its spring action, to urge movable valve element 102 into sealing contact with valve seat 106. With this particular embodiment of the invention, the calculations for breathing effort are substantially the same as the one presented for the air valve 81 of FIG. 3 since force $F_1$ remains constant and the sealing force $F_2$ is the only force that will have to be overcome. Therefore, the force which has to be supplied by the diver is small and constant, it being the sealing force of about 0.64 pounds.

While the invention has been explained and described with particular reference and emphasis to the demand state of a scuba regulator, it is to be understood that the invention is most useful for such breathing equipment as used for safely breathing such as used by fire fighters or were other fumes harmful to health may be encountered. Further, the invention is likewise useful for medical inhalation and for commercial diving. In addition, the invention is useful where it is desired to control regulators which regulate very high pressures with low pressures.

There has been described hereinabove a balanced demand valve which can be opened and maintained open with the substantially same, constant, low force, namely the sealing force. This valve may be constructed with a movable valve element supported by a flexible sealing membrane or a sealing bellows or some other sealing means such as an O-ring.

I claim:

1. A balanced stage for a regulator for divers, comprising:

an enclosure including a low pressure chamber having an opening sealingly covered by a flexible diaphragm and outlet means adapted to be connected to a mouthpiece, one side of said diaphragm being exposed to the pressure in said low pressure chamber and the other side to ambient pressure;

an intermediate pressure air supply; and air valving means for providing an air flow path between said low pressure chamber and said air supply, said valving means including a stationary valve seat, a valve element having a gas passage therethrough cooperating with said seat and movable between a closed position and an open position to allow air from said air supply to flow into said low pressure chamber via said gas passage, and a flexible means nonslidingly affixed to said valve element for supporting said element for movement between said closed and open positions, said flexible means being configured and placed to sealingly separate said low pressure chamber and said air supply except for gas flow through said gas passage when said valve element is in said open position, and actuating means connected between said diaphragm and said valve element to move said valve element between sand open and closed position to thereby control the pressure in said low pressure chamber.

2. A balanced stage in accordance with claim 1 in which said valve element is generally of tubular configuration defining an interior and exterior peripheral surface with the interior surface exposed to the low pressure chamber pressure.

3. A balanced stage in accordance with claim 2 in which said flexible means is a membrane in sealing contact with the exterior surface of said valve element and the interior surface of said enclosure.

4. A balanced stage in accordance with claim 3 in which said membrane is shaped in the form of an annulus and said valve element is shaped in the form of a hollow cylinder.

5. A balanced stage in accordance with claim 2 in which said flexible means is a tubular bellows with one end portion in sealing contact with said valve element and the other end portion in sealing contact with said enclosure.

6. A balanced second stage for a two stage demand regulator for divers comprising:

an enclosure having at least a hollow interior cylindrical space disposed between a low pressure region and an intermediate pressure region, with the low pressure region including outlet means adapted to be connected to a mouthpiece and control means for controlling the pressure therein; and valving means for providing a controlled air flow path between said low pressure and intermediate pressure regions disposed in said cylindrical space and including, a valve seat, a valve element responsive to said control means and having a gas passage therethrough with one end thereof constituting a sealing end portion for cooperating with said valve seat, and flexible means supporting said valve element for movement between a closed and open position and for sealingly separating said low pressure and said intermediate pressure regions except for gas flow through said gas passage when said valve element is in said open position, said flexible means having one end portion in nonsliding sealing contact with the peripheral surface of said interior cylindrical space and the other end portion in nonsliding sealing contact with the peripheral exterior surface of said valve element.

7. A balanced second stage in accordance with claim 6 in which said flexible means is an annular membrane with its interior peripheral surface in sealing contact with said valve element and its exterior peripheral surface in sealing contact with said interior cylindrical space.

8. A balanced second stage in accordance with claim 6 in which said flexible means is formed of a tubular bellows, one end portion of said bellows being integral with said valve element and the other end portion of said bellows sealingly connected to said cylindrical interior space.

9. A balanced second stage in accordance with claim 8 in which said bellows is compressed to a length such that the valve element is urged against said valve seat with a preselected sealing force.

10. In a scuba second stage regulator in which a regulator control chamber has first, second, and third openings, a flexible diaphragm covering said first opening, a mouthpiece tube with a one way valve covering said second opening, and an air supply connected to said third opening, said air supply including an air valve, and a demand lever in said control chamber which is connected between said valve and said diaphragm, said diaphragm being responsive to the difference in pressure between the interior of said chamber and ambient and operative to open said valve to allow air flow therethrough into said chamber, the improvement of said air valve comprising:

an end bearing stationary valve seat;

a valve element having a gas passage therethrough with one end of said gas passage constituting a valve seal ring for sealingly engaging said valve seat when urged against it;

flexible sealing means having one end nonslidingly connected to the interior surface of said chamber and the other end nonslidingly connected to the external surface of said valve element for supporting said valve element for limited movement between an open and a closed position and for sealingly partitioning the interior of said chamber from the air of said air supply except for said gas passage when said valve is in the open position; and spring means for biasing said valve element for sealing contact with said valve seat, the demand lever being connected to said valve element and acting in opposition to said spring means upon opening of said air valve.

11. In a scuba second stage regulator in accordance with claim 10 in which said valve element is a hollow cylinder and in which the interior of said cylinder is in communication with the interior of said chamber.

12. In a scuba second stage regulator in accordance with claim 11 in which said flexible sealing means is an annular membrane.

13. In a scuba second stage regulator in accordance with claim 11 in which said flexible sealing means is a bellows.

14. In a scuba second stage regulator in accordance with claim 13 in which said spring means and said bellows formed a unitary structure.

15. In a scuba second stage regulator in accordance with claim 13 in which said spring means, said valve element and said flexible means form a unitary structure.

16. A balanced demand stage for a breathing pressure regulator for divers comprising, in combination:

an enclosure including a low pressure chamber and an intermediate pressure chamber, the low pressure chamber having a first opening and a second opening;

a flexible diaphragm covering said first opening and having opposite surfaces exposed, respectively, to the low pressure in said low pressure chamber and to ambient pressure;

a breathing mouthpiece with a one way valve connected to said second opening; and an air valving system sealingly disposed between said low and said intermediate pressure chamber for controlling air flow into said low pressure chamber, said valving system including:

a tubular end-sealing valve element having a gas passage therethrough movable between an open position and a closed position and defining an interior and an exterior surface, said interior surface and a portion of said exterior surface being, respectively, in communication with said low and said intermediate pressure chamber when in said open position;

a stationary valve seat for sealingly cooperating with said movable valve element;

flexible means for supporting said movable valve element and for sealingly separating said low and intermediate pressure chamber from one another except for said gas passage when said valve element is in said open position, and for normally urging said valve element into sealing contact with said valve seat; and means responsive to the pressure differential across the diaphragm coupled to said valve element and operative to move said element from normally closed to said open position in accordance with the pressure differential across said diaphragm.

17. A balanced demand stage for a breathing pressure regulator as recited in claim 16 in which said flexible means comprises an annular membrane and a compression spring for biasing said valve element into sealing contact with the valve seat.

18. A balanced demand stage for a breathing pressure regulator as recited in claim 17 in which said flexible means comprises a partially compressed bellows.

* * * * *